United States Patent [19]

Bubar

[11] 4,035,682

[45] July 12, 1977

[54] UNIVERSAL BURNING ALKALI METAL VAPOR LAMP WITH AMALGAM STORAGE IN EXHAUST TUBULATION

[75] Inventor: Stanley F. Bubar, Chagrin Falls, Ohio

[73] Assignee: General Electric Company, Schenectady, N.Y.

[21] Appl. No.: 718,062

[22] Filed: Aug. 26, 1976

[51] Int. Cl.[2] ..... H01J 61/22; H01J 61/28; H01J 61/30

[52] U.S. Cl. ..... 313/174; 313/176; 313/180; 313/220; 313/229

[58] Field of Search ..... 313/174, 176, 180, 220, 313/229

[56] References Cited

U.S. PATENT DOCUMENTS

| | | | |
|---|---|---|---|
| 2,251,923 | 8/1941 | Druyvesteyn | 313/174 |
| 3,974,410 | 8/1976 | Collins et al. | 313/229 X |
| 3,983,439 | 9/1976 | Blommerde et al. | 313/174 |

*Primary Examiner*—Palmer C. Demeo
*Attorney, Agent, or Firm*—Ernest W. Legree; Lawrence R. Kempton; Frank L. Neuhauser

[57] ABSTRACT

In a high pressure alkali metal vapor lamp arc tube having a sealed off metal exhaust tube projecting through an end closure, the tip of the exhaust tube is the cold spot where excess alkali metal condenses. A fine mesh screen friction-retained in the exhaust tube prevents passage of liquid droplets; any alkali metal impinging on the screen is slowly revaporized and condenses at the tip due to the higher temperature at the screen.

5 Claims, 3 Drawing Figures

UNIVERSAL BURNING ALKALI METAL VAPOR LAMP WITH AMALGAM STORAGE IN EXHAUST TUBULATION

The invention relates to alkali metal vapor discharge lamps and is particularly useful with high pressure sodium vapor lamps utilizing alumina ceramic envelopes.

BACKGROUND OF THE INVENTION

The now well-known high intensity sodium vapor lamp is described in U.S. Pat. No. 3,248,590 — Schmidt, 1966. "High Pressure Sodium Vapor Lamp,", and generally comprises an outer vitreous envelope or jacket of glass within which is mounted a slender tubular ceramic arc tube. The arc tube is made of a light transmissive refractory oxide material resistant to alkali metals at high temperatures, suitably high density polycrystalline alumina or synthetic sapphire. The filling comprises sodium along with a rare gas to facilitate starting, and mercury for improved efficiency. The ends of the alumina tube are sealed by suitable closure members affording connection to the electrodes. The outer envelope which encloses the ceramic arc tube is generally provided at one end with a screw base comprising shell and center contact to which the electrodes of the arc tube are connected.

The high pressure sodium vapor lamp contains an excess amount of sodium mercury amalgam, that is it contains more amalgam than is vaporized when the lamp reaches a stabilized operating condition. By having an excess, the vapor pressure is determined by the lowest operating temperature at any point in the arc tube and the quantity supplied is not critical. As the lamp ages, some of this excess amalgam is needed to replace that lost during the life of the lamp, for instance by electrolysis through the alumina walls.

In some lamps wherein the arc tube is symmetrical end for end, sometimes referred to as a universal burning design, the cold spot where the excess amalgam collects is located within the arc tube proper. An example of such a design is described in U.S. Pat. No. 3,609,437 — Tol et al., wherein the arc tube has no exhaust tube and the amalgam charge is inserted into the arc tube just prior to sealing the second end closure within an inert gas-filled furnace. In such a design, the position of the excess amalgam when the lamp is operating is determined by temperature and gravity. The excess amalgam migrates to the coolest spot within the arc tube and gravity pulls it to the lowest position possible, generally to the closure at the lower end which is directly exposed to electrode heat. Deposition of electrode material on the arc tube walls during life tends to darken them and darkening is greatest at the ends near the electrodes. The resulting oven effect raises the temperature of the cold spot, causing more sodium to be vaporized which in turn causes lamp voltage to rise. It is a general characteristic of high pressure sodium lamps that the lamp operating voltage increases with life and the end of life occurs when the voltage supplied by the ballast is no longer sufficient to sustain lamp operation. At this point the lamp may cease to operate altogether or will cycle on and off due to the high voltage starting pulse supplied by the ballast. Thus the life of high pressure sodium lamps is dependent upon the rate of voltage rise. In prior art universal burning lamps, the oven effect aggravates voltage rise with the result that such lamps are relatively short lived.

In another well-known lamp design illustrated in U.S. Pat. No. 3,708,710 — Smyser et al., the excess sodium mercury amalgam is condensed in a reservoir external to the arc tube proper. This contruction utilizes at least one tubular inlead of niobium which is used as an exhaust tube and has an opening into the interior of the arc tube. After the lamp has rceived its filling, the exhaust tube is hermetically tipped off and the heat balance is such that the tipped end becomes the cold spot in which the excess amalgam collects. The excess amalgam is now in the location removed from the direct heat of the arc and of the electrode, and arc tube blackening as the lamp ages now has a minimal effect on sodium vapor pressure and on lamp voltage. Also the use of an external reservoir facilitates fine tuning the heat balance, for instance by grit blasting the reservoir to regulate the heat loss in order to adjust the temperature to the optimum for lumen output and long life.

The external reservoir construction has had the drawback that the exhaust tube must be located lowermost. This has necessitated two versions of a given lamp, a base-up and a base-down design, the arc tube being inverted relative to the jacket in one as against the other. If either version is used in the incorrect orientation, vibration or mechanical shock may cause a droplet of amalgam to drop out of the exhaust tube into the arc tube. Since the arc region is at a much higher temperature, there will be a sudden rise in sodium and mercury vapor pressures and a corresponding increase in lamp voltage. This can be severe enough to cause the lamp to extinguish when the lamp voltage exceeds the maximum sustaining voltage of the ballast. There are many applications where such interruption of light or blinking cannot be tolerated. In extreme cases, the relatively cool amalgam droplet has been known to cause thermal cracking of the arc tube when its strikes, thereby ending the useful life of the lamp.

SUMMARY OF THE INVENTION

The object of the invention is to provide a new and improved external reservoir lamp construction which allows the lamp to be burned in any orientation without the disadvantages or limitations previous described.

My invention provides a means for retaining alkali metal in the exhaust tubulation while allowing thermal transport of the metal vapor in accordance with normal operation. Such means, broadly stated, in an obstruction interposed in the tubulation between the vent and the sealed end which restricts the passage to the multiplicity of fine capillary openings.

In a preferred embodiment, the means consists in a formed metal screen which is inserted in the niobium exhaust tube prior to tipping, that is prior to pinching off the end. The screen is of fine mesh to provide a large surface area with small orifices such that passage of an impinging liquid droplet is effectively prevented. The screen is located at an intermediate point in the exhaust tube which is at a higher temperature than the tipped end. Any amalgam impinging on the screen is subsequently slowly revaporized due to the higher temperature of the screen and recondensed at the cold spot at the end of the tube. However the temperature difference is not large enough to cause a pressure rise great enough to noticeably affect the operation of the lamp.

DETAILED DESCRIPTION

Figure 1:
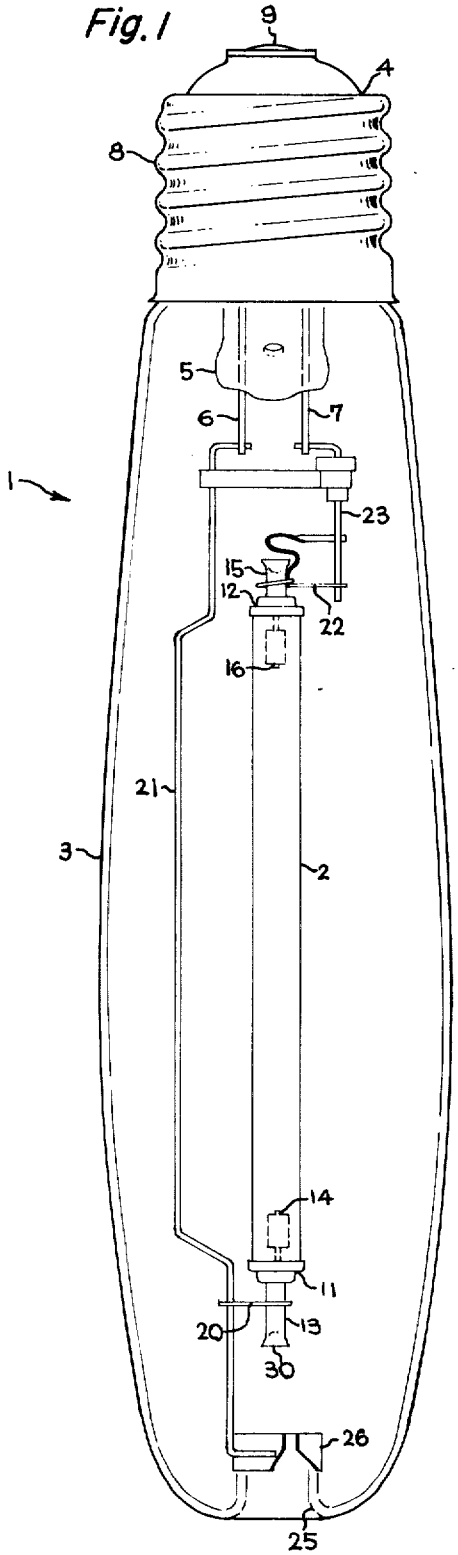
FIG. 1 shows a high pressure sodium vapor lamp embodying the invention and suitable for universal burning.

Referring to FIG. 1, the illustrated lamp 1 embodying the invention is a jacketed high pressure sodium vapor lamp rated at 400 watts. The lamp comprises an inner ceramic arc tube 2 enclosed within an evacuated outer envelope 3 of glass to the neck of which is attached a standard mogul screw base 4. The outer envelope or jacket comprises a re-entrant stem press 5 through which extend a pair of relatively heavy inlead conductors 6,7 whose outer ends are connected to screw shell 8 and eyelet 9 of the base.

Arc tube 2 centrally located within the outer envelope comprises a length of light-transmitting ceramic tubing, suitably polycrystalline alumina ceramic which is translucent or single crystal alumina which is clear and transparent. End closures consisting of metal caps 11,12 of niobium which matches the expansion coefficient of alumina ceramic, are sealed to the ends of the tube by means of a glassy sealing composition. A metal tube 13, suitably of niobium or tantalum, extends through lower cap 11 and serves as an exhaust and fill tubulation during manufacture of the lamp. In the finished lamp, tube 13 is pinched and sealed shut at its outer end and serves as a reservoir in which excess sodium mercury amalgam condenses during operation. Electrode 14 within the lamp is attached to the inward projection of exhaust tube 13, and a dummy exhaust tube 15 extending through metal end cap 12 supports the other electrode 16. Both electrodes may consist of tungsten wire 17 coiled on a tungsten shank 18 suitably in two superposed layers. The shank also supports an anti-back-arcing shield in the form of a metal disc 19. The electrodes are activated by metal oxides retained in the interstices between turns of the coil, a preferred material being dibarium calcium tungstate. By way of example, the filling for the illustrated arc tube which is 112 millimeters long by 7 millimeters in bore comprises xenon at a pressure of 20 torr serving as a starting gas, and a charge of 25 mg. of amalgam of 25 weight percent sodium and 75 weight percent mercury.

Exhaust tube 13 is connected by connector 20 and long frame member or side rod 21 to inlead 6 which provides circuit continuity to screw shell 8. Dummy exhaust tube 15 extends through a ring support 22 fastened to short L-shaped rod 23; the arrangement provides lateral restraint while allowing axial expansion of the arc tube. A flexible metal strap 24 connects dummy tube 15 to short rod 23 which in turn is welded to inlead 7, thereby providing circuit continuity to base eyelet 9. The distal end of long side rod 21 is braced to inverted nipple 25 in the dome end of the envelope by a clip 26 which engages it.

In the lamp manufacturing sequence followed by the prior art, the end cap and electrode assemblies are sealed to the ends of the alumina arc tube within a vacuum furnace at a temperature sufficiently high to melt the metal oxide sealing composition which cements the end caps 11 and 12 to the ceramic. At this point the exhaust tube 13 is still open, that is its outer end is not pinched shut as illustrated in the drawing, and lateral apertures or vents 27 in tube 13 give access to the interior of the arc tube. In accordance with my invention, a formed metal screen 28 is now inserted into exhaust tube 13 to proximity with the vents 27. The screen is of fine mesh, suitably 100 mesh or greater, to provide a large surface area with small orifices so that passage of an impinging liquid droplet will be effectively prevented.

By way of example, in the illustrated lamp the niobium exhaust tube 13 has an inside diameter of approximately 0.100 inch. A suitable screen may be made by cutting a 3/16 inch diameter disc from 100 mesh tungsten screening and cupping the disc by pressing it into a 3/32 inch diameter hemispherical cup from which it springs out and expands by its own resilience. The cupped screen is then driven nose first into the exhaust tube by means of a slender wand, and thereafter it is friction-retained in the exhaust tube about in the shape and at the position illustrated. The empty arc tube is then dosed in a chamber which is exhausted of air and filled with the inert gas which will serve as starting gas in the finished article. Within this chamber a feed device releases a ball of liquid sodium mercury amalgam into the exhaust tube, the ball being slightly larger than indicated at 29 in FIG. 3. The sodium mercury amalgam has previously been heated to a temperature above room temperature where it is liquid and flows readily. A mechanical device then pinches shut the end of tube 13 as indicated at 30 with sufficient force to make a hermetic cold weld.

Suitable screen materials are tungsten, molybdenum and stainless steel. Nickel is not suitable in conjunction with a niobium exhaust tube because it dissolves into the niobium.

Figure 2:
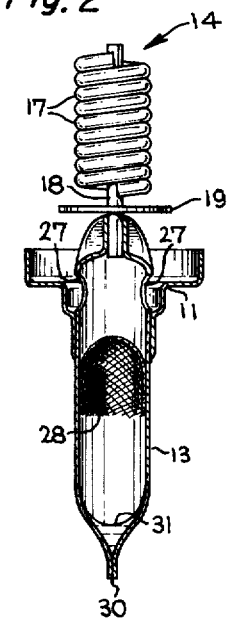
FIG. 2 is an enlarged detail of the end closure and external reservoir.

In the operation of the lamp, if exhaust tube 13 which serves as an external reservoir is lowermost, the excess sodium mercury amalgam condenses in a wedge-shaped volume 31 as shown in FIG. 2, next to the cold spot which is the pinched end 30. The usual advantage of the external reservoir construction is obtained permitting close control of the vapor pressure within the arc tube by regulating the heat balance which determines the temperature of the reservoir tip 30. In this orientation corresponding to the base-up position for the illustrated lamp, the sodium and mercury vapors pass freely through the screen 28 and the excess amalgam always remains at 31 as indicated in FIG. 2.

Figure 3:
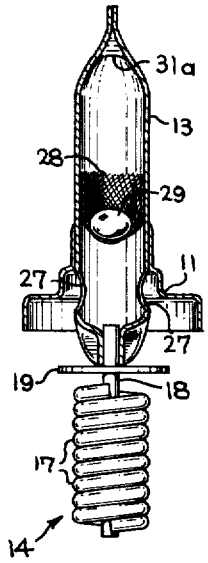
FIG. 3 is an inverted view similar to FIG. 2 showing the screen trapping amalgam.

If the lamp is inverted in the base-down position, the external reservoir will have the orientation shown in FIG. 3. Even with this inversion, the surface tension or capillary attraction of the sodium mercury amalgam is normally sufficient to hold the excess in a wedge-shape volume at the tip of niobium tube 13. However it does happen under the stress of vibration of mechanical shock that a droplet of amalgam breaks loose from the wedge-shaped volume. In such case the falling droplet is caught by screen 28 as indicated at 29 in FIG. 3. The fine mesh of the screen assures that drop 29 does not pass through by breaking up into a multitude of smaller droplets. In the heat balance of the end of the lamp, electrode 14 is the source of heat, cup 11 is at a relatively high temperature and the temperature drops along exhaust tube 14 all the way to tip 30. The rise in temperature from tip 30 to the location of screen 28 may be from 10° to 20° C. Due to this temperature difference, the amalgam drop 29 is slowly vaporized and recondenses at the tip by adding itself to the wedge-shaped volume 31*a*. However the temperature difference between the screen and the tip is not high enough to cause a vapor pressure rise which would be noticeable in the operation of the lamp. Eventually the little ball of amalgam 28 disappears entirely and the amalgam volume 31*a* in FIG. 3 grows back to the size of the volume 31 in FIG. 2. The excess amalgam so remains until circumstances allow another droplet to form and fall whereupon the sequence which has been described is repeated.

The fine mesh screen 28 is inexpensive, easily inserted in place, and fully effective and for this reason is preferred as the obstruction means. But alternatives are available, for instance a small wad of fine tungsten wire pushed into tube 13, or a body of appropriate size with capillary interstices.

My invention thus retains all the advantages of high luminous efficiency and close color regulation achieved by the external reservoir construction and at the same time obtains the benefit of universal burning position without shortened life or blinking during operation.

What I claim as new and desire to secure by Letters Patent of the United States is:

1. An alkali metal vapor lamp comprising a tubular elongated envelope of light-transmitting ceramic material, said envelope having a pair of electrodes sealed into opposite ends, one end of said envelope having a metal exhaust tubulation sealed thereto, an ionizable medium including alkali metal sealed within said envelope in a quantity exceeding that vaporized during normal operation of said lamp, said exhaust tubulation having a vent opening into the interior of said envelope and being sealed off at its outer end, the heat balance in said envelope making the sealed end of said tubulation the cold spot of said envelope, and an obstruction means in said tubulation interposed between said vent and the sealed end and located at a place within said tubulation which is appreciably higher in temperature than said sealed end, said obstruction means restricting the passage between the vent and the sealed end to a multiplicity of capillary openings.

2. A sodium vapor lamp as in claim 1 wherein the ionizable medium comprises sodium-mercury amalgam.

3. A sodium vapor lamp as in claim 1 wherein the ionizable medium comprises sodium-mercury amalgam and wherein said tubulation is of niobium and the outer end is sealed in a wedge shape which serves to retain excess amalgam by capillary attraction.

4. A lamp as in claim 1 wherein said obstruction means is a fine mesh metal screen.

5. A lamp as in claim 3 wherein said obstruction means is a fine mesh metal screen friction-retained at an intermediate point in said tubulation.

* * * * *